US009663908B2

(12) United States Patent
Impero

(10) Patent No.: US 9,663,908 B2
(45) Date of Patent: May 30, 2017

(54) ROADSIDE CRASH CUSHION

(71) Applicant: Pasquale Impero, Casalnuovo di Napoli (IT)

(72) Inventor: Pasquale Impero, Casalnuovo di Napoli (IT)

( * ) Notice: Subject to any disclaimer, the term of this patent is extended or adjusted under 35 U.S.C. 154(b) by 0 days.

(21) Appl. No.: 14/776,770

(22) PCT Filed: Mar. 13, 2014

(86) PCT No.: PCT/IB2014/059738
§ 371 (c)(1),
(2) Date: Sep. 15, 2015

(87) PCT Pub. No.: WO2014/141134
PCT Pub. Date: Sep. 18, 2014

(65) Prior Publication Data

US 2016/0024732 A1 Jan. 28, 2016

(30) Foreign Application Priority Data

Mar. 15, 2013 (IT) ..... BO2013A0115

(51) Int. Cl.
*E01F 15/00* (2006.01)
*E01F 15/14* (2006.01)

(52) U.S. Cl.
CPC ..... *E01F 15/145* (2013.01); *E01F 15/146* (2013.01)

(58) Field of Classification Search
CPC ..... E01F 15/145; E01F 15/146
USPC ..... 256/13.1; 404/6, 9, 10
See application file for complete search history.

(56) References Cited

U.S. PATENT DOCUMENTS 4,190,275 A 2/1980 Mileti
4,583,716 A * 4/1986 Stephens ..... E01F 15/146 188/377
4,674,911 A * 6/1987 Gertz ..... F16F 9/049 256/13.1
5,660,496 A * 8/1997 Muller ..... E01F 15/146 256/13.1
6,536,986 B1 3/2003 Anghileri et al.
6,713,844 B2 * 3/2004 Tatsuta ..... H01L 21/563 174/535
6,905,281 B2 * 6/2005 Kang ..... E01F 15/146 404/6

(Continued)

*Primary Examiner* — Michael P Ferguson
*Assistant Examiner* — Nahid Amiri
(74) *Attorney, Agent, or Firm* — R. Neil Sudol; Henry D. Coleman

(57) ABSTRACT

A roadside crash cushion (1), comprising: a guide rail (2) fixed to a road surface; a plurality of sliding supports (3), which slidably engage along the guide rail (2); a plurality of collapsible tubular elements (4) arranged horizontally one after another, which are supported by the plurality of sliding supports (3) and which each have a straight development axis and are fixed to the plurality of sliding supports (3). Each collapsible tubular element (4) of the plurality of collapsible tubular elements (4) exhibits a length and a transversal section that are in a reciprocal relation to one another such as to determine an irreversible deformation to compression of the collapsible tubular element (4) which determines the collapse thereof along the development axis thereof when the collapsible tubular element (4) is subjected to an axial force at least equal to a critical force.

8 Claims, 6 Drawing Sheets

(56) References Cited

U.S. PATENT DOCUMENTS

| | | | | |
|---|---|---|---|---|
| 7,168,880 | B2 * | 1/2007 | Kennedy, Jr. | C08G 18/10 404/10 |
| 7,396,184 | B2 * | 7/2008 | La Turner | E01F 15/146 404/10 |
| 8,016,513 | B2 * | 9/2011 | Shin | E01F 15/146 404/6 |
| D691,906 | S * | 10/2013 | Impero | D10/113.3 |
| 8,596,903 | B2 * | 12/2013 | Hur | E01F 15/146 256/13.1 |
| 2005/0211520 | A1 | 9/2005 | Abu-Odeh et al. | |
| 2007/0286675 | A1 * | 12/2007 | Kennedy, Jr. | C08G 18/10 404/6 |
| 2008/0181722 | A1 * | 7/2008 | McKenney | E01F 15/146 404/6 |
| 2010/0080652 | A1 | 4/2010 | Shin | |
| 2011/0091273 | A1 * | 4/2011 | Sayre | C08G 18/10 404/6 |
| 2012/0121325 | A1 * | 5/2012 | Buehler | E01F 15/146 404/6 |

* cited by examiner

ROADSIDE CRASH CUSHION

FIELD OF INVENTION

The present invention relates to the technical sector of roadside crash cushions.

DESCRIPTION OF THE PRIOR ART

Roadside crash cushions are positioned along roads to screen fixed obstacles, such as spires (for example guardrails) or bridge abutments, which can seriously threaten the safety of the occupants of a vehicle in a case of impact against these objects.

Roadside crash cushions in particular have the function of deadening an impact of a vehicle; they absorb the kinetic energy of the vehicle by deforming during the impact.

Roadside crash cushions are usually applied together with road safety barriers, i.e. guardrails. For example, a roadside crash cushion can be provided at an exit of a motorway, where the guardrails form a spire shape.

Document U.S. Pat. No. 6,179,516 discloses a roadside crash cushion, comprising: a guide rail fixed to the road surface; a plurality of vertical sliding supports which slidably engage along the guide rail; a plurality of collapsible tubular elements which are arranged horizontally one following another, which are supported by the plurality of sliding supports and which each have a straight development axis; and a plurality of support bars and horizontal guides.

The sliding supports are interposed with regularity between the collapsible tubular elements and also support the support and guide bars; in particular the sliding supports engage slidably also with the support and guide bars.

The support and guide bars are parallel to one another and are parallel to the collapsible tubular elements; further, the support and guide bars contact the lateral surface of the collapsible tubular elements so as to support them. Additionally, the support and guide bars are constituted by a plurality of cylindrical elements of different diameters and slidable on one another in a case of axial impact.

The support and guide bars are distributed about the lateral surface of each collapsible tubular element so as to guide it axially in a case of collapse of the same collapsible tubular element following an impact of a vehicle against the roadside crash cushion.

In a case of axial impact the sliding supports slide along the guide rail and along the support and guide bars and the collapsible tubular elements collapse on themselves, i.e. they collapse axially because of the guide function exerted by the support and guide bars; the kinetic energy of the vehicle is transformed into deforming energy of the collapsible tubular elements and the absorption of energy of the crash cushion is optimal. If the impact is lateral, and therefore not only an axial force but also a transversal force is released on the crash cushion, it can happen that the sliding supports cannot slide along the support and guide bars and the cylindrical elements of the support and guide bars cannot slide one internally of another; as a consequence, the roadside crash cushion deforms uncontrolledly and with insufficient energy absorption, with a serious risk to the safety of the occupants of the vehicle.

A further drawback of this roadside crash cushion is the cost: in fact, it comprises a large number of components, on the one side, and requires a considerable time for the assembly thereof on the other side.

SUMMARY OF THE INVENTION

The aim of the present invention consists in obviating the above-cited drawbacks.

The above aim has been attained with a roadside crash cushion according to claim 1.

In the roadside crash cushion of the prior art described herein above, the collapsible tubular elements are arranged in the housing formed by the support and guide bars or by the sliding supports; the support and guide bars guide the deformation of the collapsible tubular elements so that they collapse on themselves in an axial direction; therefore, the collapsible tubular elements are subjected to a plastic compressive deformation (folding) which enables absorption of a high quantity of deforming energy, as the quantity of material participating in the plastic deforming process is maximized.

The present invention advantageously does not comprise the support and guide bars: each collapsible tubular element has a length and a transversal section that are in a relation with one another such as to determine the collapse of the collapsible tubular element along the relative development axis when the tubular element is subjected to an axial force at least equal to a critical force. In fact it is known that a collapsible tubular element can be designed to have a transversal section and a length such that an axial force determines a compressive plastic deformation (folding) without the need to use any guide means in the deformation. The collapsible tubular elements of the invention are designed according to this principle: therefore, the present invention is constituted by a smaller quantity of components than the roadside crash cushion of known type and thus, apart from having smaller production costs, the assembly is more rapid. Further, the lack of the support and guide bars enables having a satisfactory reaction of the roadside crash cushion also for lateral impacts.

BRIEF DESCRIPTION OF THE DRAWINGS

Specific embodiments of the invention will be described in the following description, in accordance with what is set down in the claims and with the aid of the appended tables of drawings, in which:

DESCRIPTION OF PREFERRED EMBODIMENTS

Figure 1:
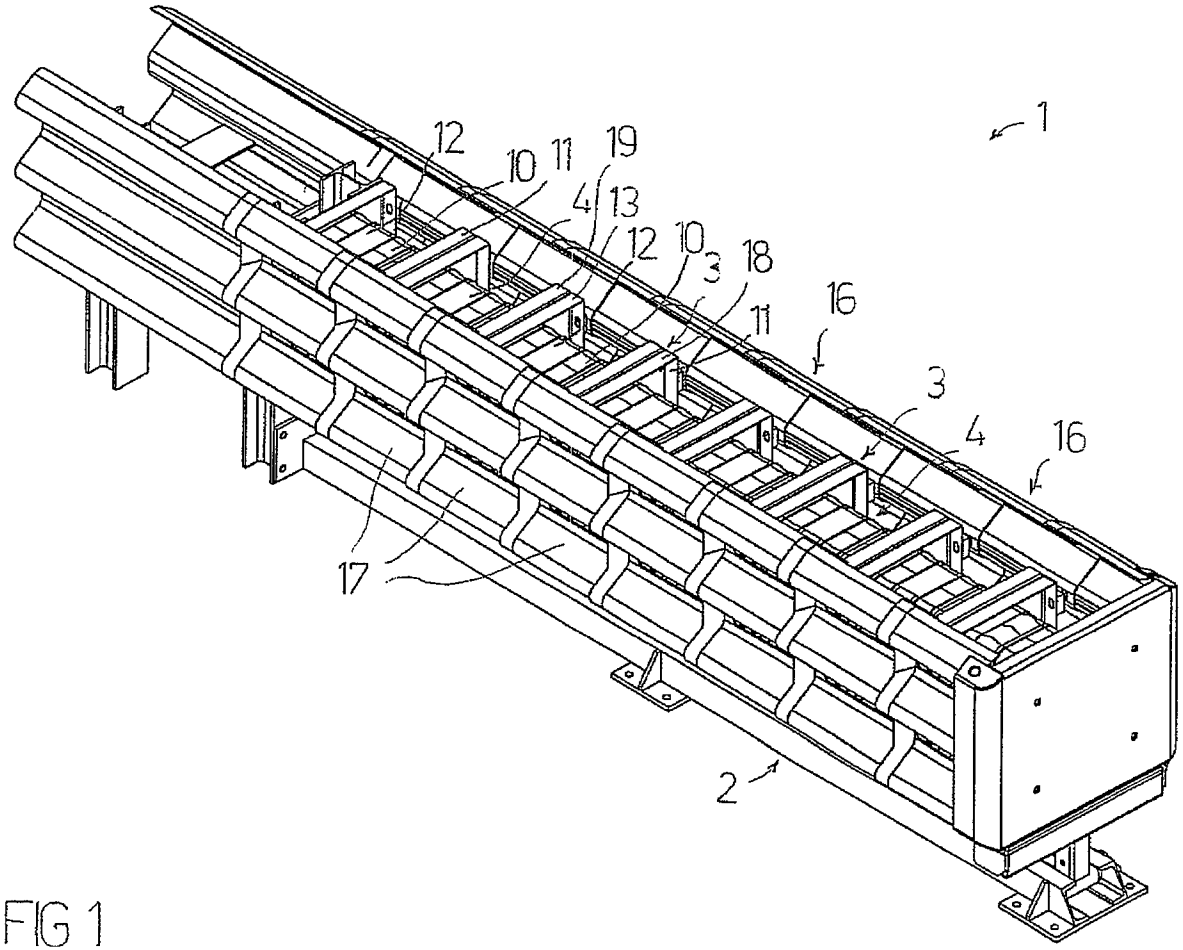
FIGS. 1 and 2 illustrate two perspective views of a first embodiment of the roadside crash cushion of the present invention, in which different lateral coverings have been used.

With reference to the appended tables of drawings, (1) denotes in its entirety a roadside crash cushion, object of the present invention.

The roadside crash cushion (1) comprises: a guide rail (2) fixed to a road surface (road surface not illustrated); a plurality of sliding supports (3), which slidably engage along the guide rail (2); a plurality of collapsible tubular elements (4) which are made of a metal material and/or a composite material and/or a plastic material, and which are arranged horizontally one after another, which are supported by the plurality of sliding supports (3) and which each have a straight development axis and are fixed to the plurality of sliding supports (3). Each collapsible tubular element (4) of the plurality of collapsible tubular elements (4) exhibits a length and a transversal section that are in a relation to one another such as to determine an irreversible compressive deformation of the collapsible tubular element (4) which determines the collapse thereof along the development axis thereof when the collapsible tubular element (4) is subjected to an axial force at least equal to a critical force.

The present invention does not comprise support and guide bars: each collapsible tubular element (4) has a length and a transversal section which are in a mutual relation that is such as to determine the collapse of the collapsible tubular element (4) along the relative development axis when the collapsible tubular element (4) is subjected to an axial force at least identical to a critical force. It is known that a collapsible tubular element (4) can be designed so as to have a transversal section and a length that are such that an axial force determines a plastic compressive deformation (folding), without any need to use any guide means in deformation to be coupled to the collapsible tubular element (4). The collapsible tubular elements (4) of the invention are designed according to this principle: therefore they have a smaller quantity of components than the crash cushions of the prior art and thus, apart from lower production costs, the assembly thereof is more rapid. Further, the lack of support and guide bars enables having a satisfactory reaction of the crash cushion (1) even with lateral impacts, which, that is, give rise not only to an axial force but also a transversal force.

Therefore, in a case of impact the plurality of sliding supports (3) slides along the guide rail (2) and at the same time the plurality of collapsible tubular elements (4) undergoes a plastic compressive deformation (folding) which causes the collapsing thereof; this determines an excellent transformation of kinetic energy of the vehicle into deformation energy of the plurality of collapsible tubular elements (4).

The collapsible tubular elements (4) of the plurality of collapsible tubular elements (4) are preferably made of a metal material, in particular sheet metal, so that the irreversible deformation on compression determining the collapse of each collapsible tubular element (4) of the plurality of collapsible tubular elements (4) is in particular a compressive plastic deformation.

Each collapsible tubular element (4) of the plurality of collapsible tubular elements (4) preferably comprises a first portion (5) and a second portion (6) which are opposite and fixed to one another.

Each portion of the collapsible tubular element (4) preferably in turn comprises a half-shell (7) and two fixing tabs (8) arranged respectively at the opposite ends of the half-shell (7); the half-shell (7) and the fixing tabs (8) comprise in turn a plurality of walls which are adjacent to one another and which intersect, identifying corresponding edges.

At least a portion (5, 6) of the collapsible tubular element (4) can comprise at least a rib (9) which develops along a perpendicular pathway with respect to the development axis of the collapsible tubular element (4), which rib (9) is conformed so as to guide the plastic deformation of the collapsible tubular element (4) and so as to regulate the quantity of energy required to produce a certain degree of deformation of the collapsible tubular element (4) following an impact.

The first portion (5) and the second portion (6) of each collapsible tubular element (4) are formed in such a way that when fixed to one another they define a hexagonal cell.

Figure 2:
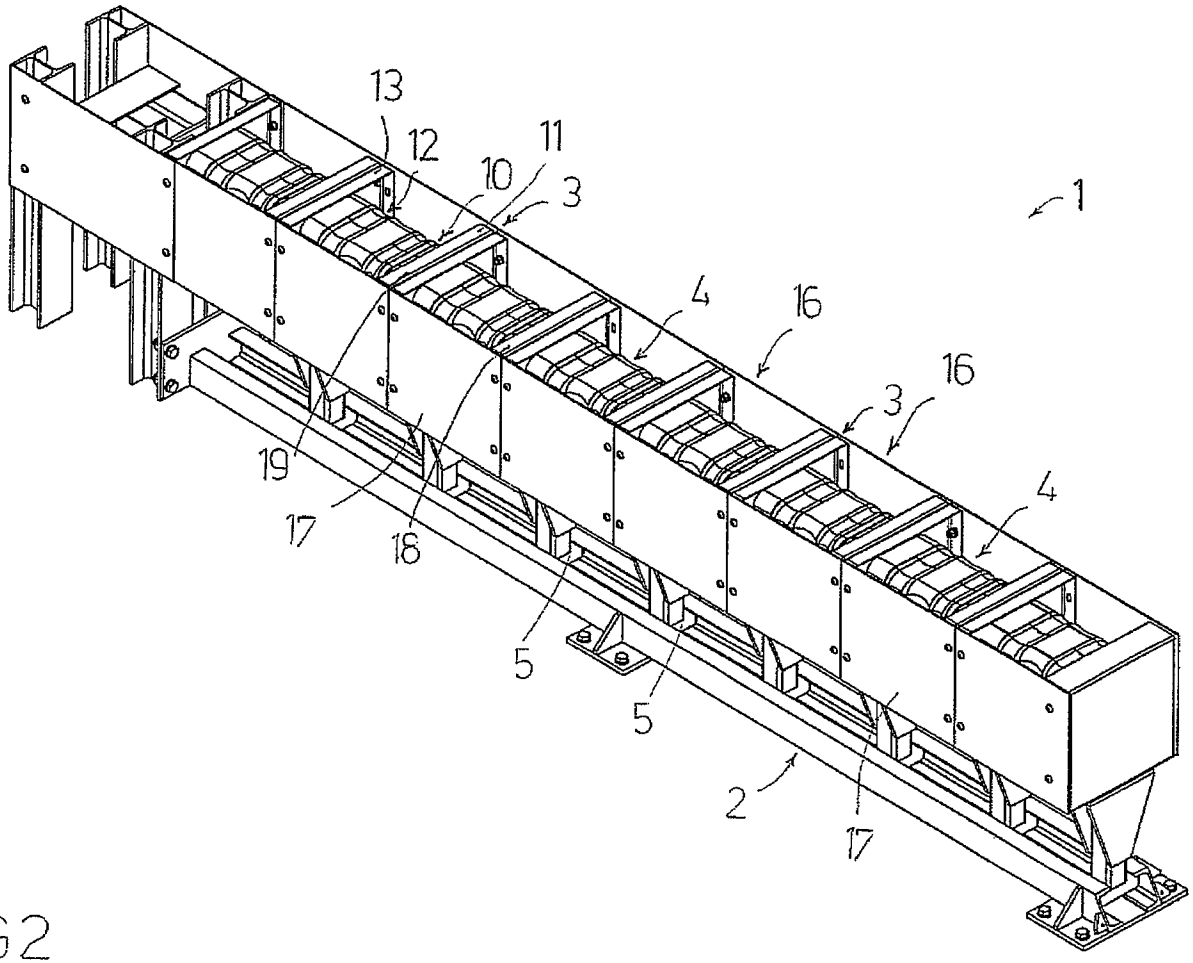
Figure 3:
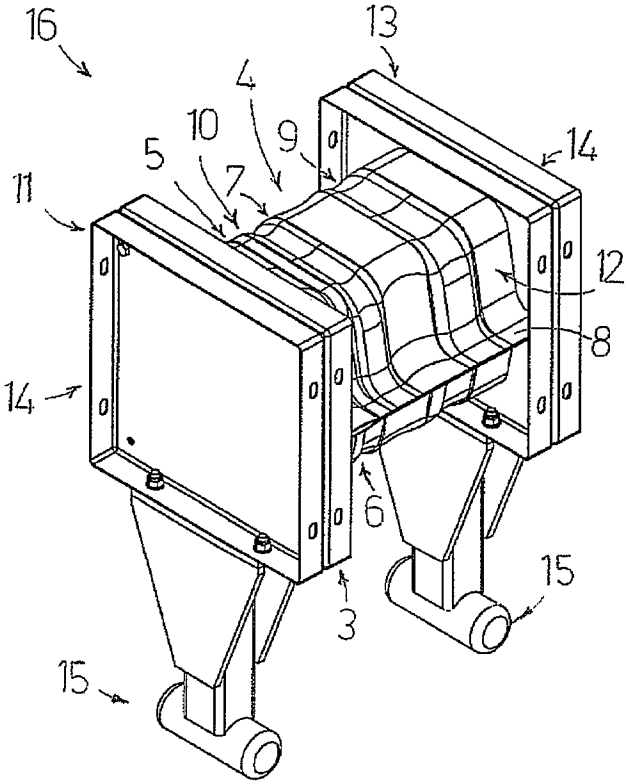
FIG. 3 is a perspective view of a part of the roadside crash cushion of FIGS. 1 and 2.

A description follows of a first embodiment of the roadside crash cushion (1) of the invention, which can be observed in FIGS. 1-3.

Each sliding support (3) of the plurality of sliding supports (3) comprises a fixing plate (14) and a carriage (15) which is connected to the fixing plate (14) and which engages with the guide rail (2).

Each collapsible tubular element (4) of the plurality of collapsible tubular elements (4) is provided with: a first end (10) fixed to the fixing plate (14) of a first sliding support (11) of the plurality of sliding supports (3); and a second end (12) fixed to a second sliding support (13) of the plurality of sliding supports (3).

The sliding supports (3) of the plurality of sliding supports (3) are preferably configured in such a way that the fixing plates (14) thereof are perpendicular with respect to the collapsible tubular elements (4) of the plurality of collapsible tubular elements (4).

The first end (10) and the second end (12) of each collapsible tubular element (4) can be fixed by welding respectively to the fixing plate (14) of the first sliding support (11) and the fixing plate (14) of the second sliding support (13).

The crash cushion (1) illustrated in FIGS. 1-3 comprises a plurality of repeating units (16) connects in series to one another; each repeating unit (16) comprises: a sliding support (3) and a collapsible tubular element (4) having a first end (10) fixed to the fixing plate (14) of the sliding support (3). The second end (12) of the collapsible tubular element (4) of a repeating unit (16) is fixed to the fixing plate (14) of the sliding support (3) of the adjacent repeating unit (16).

The roadside crash cushion (1) of the first embodiment comprises a plurality of covers (17) for covering the plurality of collapsible tubular elements (4), each cover (17) of the plurality of covers (17) being fixed to a third sliding support (18) of the plurality of sliding supports (3) and a fourth sliding support (19) of the plurality of sliding supports (3), which fourth sliding support (19) is consecutive to the third sliding support (18) and separated from the third sliding support (18) by a collapsible tubular element (4). For example, the third sliding support (18) can be identified in the first sliding support (11) and the fourth sliding support (19) can be identified in the second sliding support (13), or vice versa. In the illustrated example in FIGS. 1 and 2, the covers (17) are orientated vertically and applied to the two sides of the plurality of collapsible tubular elements (4).

In FIG. 1 the covers (17) are undulated sheets, while in FIG. 2 the covers (17) are flat plates.

Figure 4:
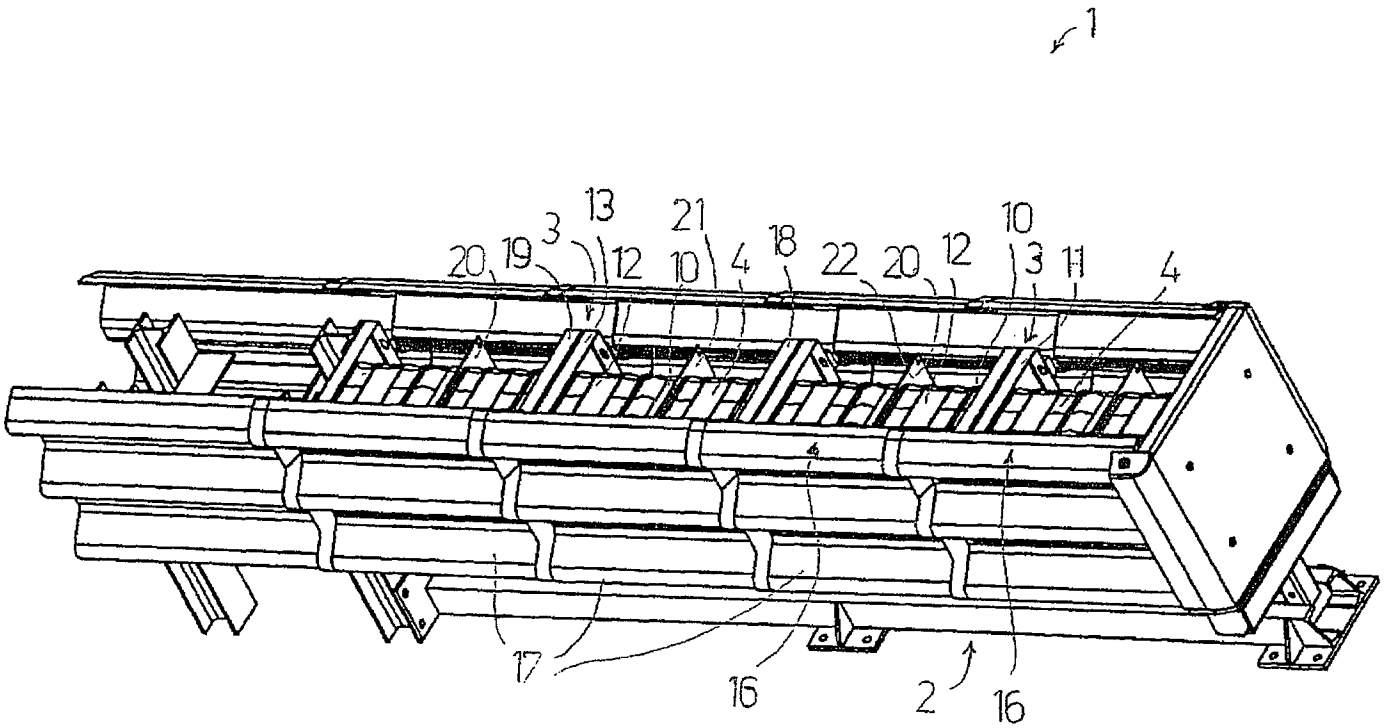
FIGS. 4 and 5 illustrate two perspective views of a second embodiment of the roadside crash cushion of the present invention, in which different lateral coverings have been used.
Figure 5:
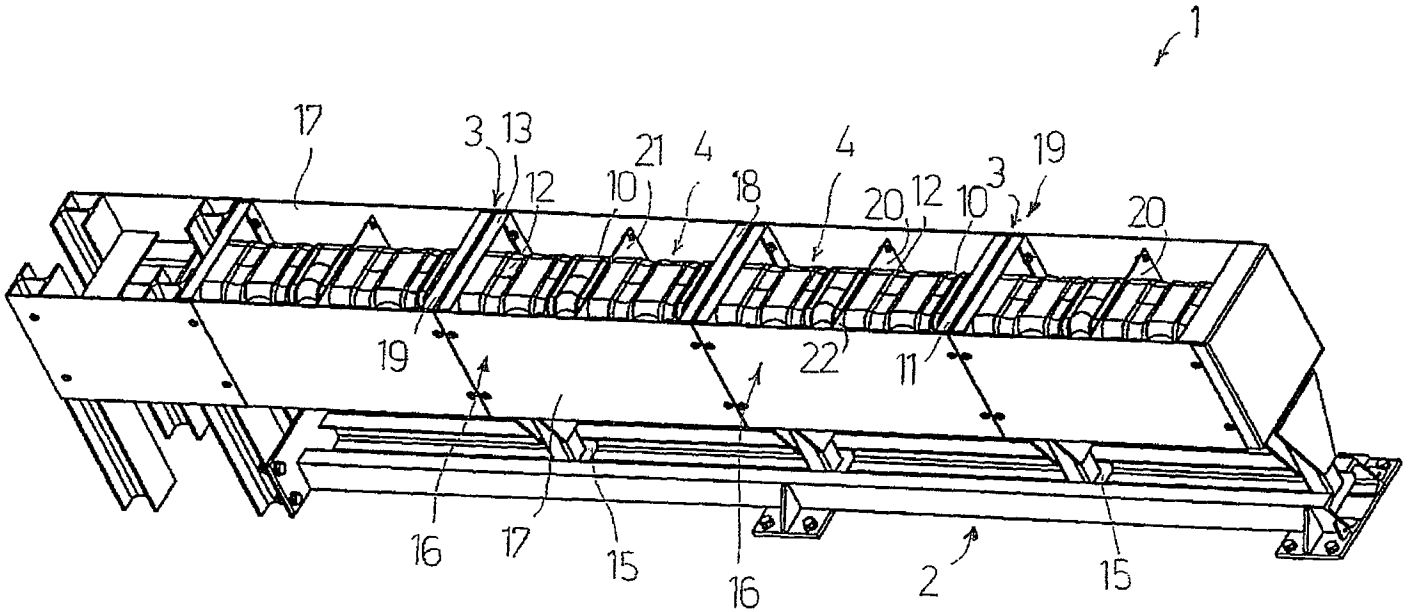
Figure 6:
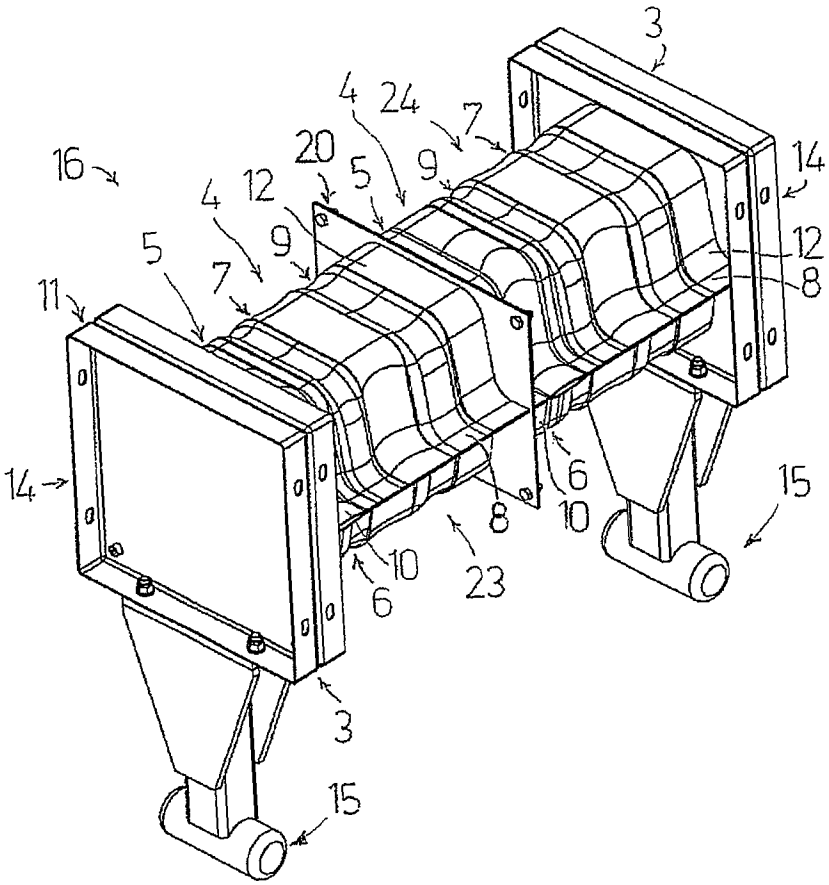
FIG. 6 is a perspective view of a part of the roadside crash cushion of FIGS. 4 and 5.

A description follows of a second embodiment, with reference to FIGS. 4-6.

Similar or equivalent characteristics to those cited for the first embodiment will be denoted using the same reference numbers.

Each sliding support (3) of the plurality of sliding supports (3) comprises a fixing plate (14) and a carriage (15) which is connected to the fixing plate (14) and which engages with the guide rail (2).

The roadside crash cushion (1) comprises a plurality of connecting plates (20). Each collapsible tubular element (4) of the plurality of collapsible tubular elements (4) is provided with: a first end (10) fixed to a first sliding support (11) of the plurality of sliding supports (3) or to a first connecting plate (21) of the plurality of connecting plates (20); a second end (12) fixed to a second sliding support (13) of the plurality of sliding supports (3) or to a second connecting plate (22) of the plurality of connecting plates (20).

The connecting plates (20) of the plurality of connecting plate (20) are arranged perpendicularly with respect to the development axis of the collapsible tubular elements (4) of the plurality of collapsible tubular elements (4). Each collapsible tubular element (4) is preferably fixed to a connecting plate (20) such that the peripheral edge thereof uniformly contacts the connecting plate (20).

An important difference between the second embodiment (FIGS. 4-6) and the first embodiment (FIGS. 1-3) is that in the second embodiment connecting plates (20) are used in substitution in a certain corresponding number of sliding supports (3) of the plurality of sliding supports (3). The connecting plates (20) are each spaced from the guide rail (2) and connected thereto only via the respective two collapsible tubular elements (4), none of the sliding supports (3) being disposed between the respective two collapsible tubular elements. The sliding supports (3) are still necessary for supporting the plurality of collapsible tubular elements (4), but they can be used in a smaller number, in the amount necessary for guaranteeing an adequate support to the collapsible tubular elements (4); advantageously, the connecting plates (20) of the plurality of connecting plates (20) are less unwieldy and less expensive than the sliding supports (3) as they only have to separate two consecutive collapsible tubular elements (4) for ensuring that they axially incur the plastic compressive deformation (folding) which has been discussed in the preceding.

The roadside crash cushion (1) illustrated in FIGS. 4-6 comprises a plurality of repeating units (16) connected in series with one another; each repeating unit (16) comprises: a first collapsible tubular element (23) having a first end (10) fixed to the fixing plate (14) of a sliding support (3) and a second end (12) fixed to a connecting plate (20); and a second collapsible tubular element (24) having a first end (10) fixed to the connecting plate (20). The second end (12) of the second collapsible tubular element (24) of a repeating unit (16) is fixed to the fixing plate (14) of a sliding support (3) of the adjacent repeating unit (16).

The use of a connecting plate (20) in each repeating unit (16) advantageously enables saving material with respect to the alternative use of a sliding support (3).

The roadside crash cushion (1) of the second embodiment can comprise a plurality of covers (17) for covering the plurality of collapsible tubular elements (4), each cover (17) of the plurality of covers (17) being fixed to a third sliding support (18) of the plurality of sliding supports (3) and a fourth sliding support (19) of the plurality of sliding supports (3), which fourth sliding support (19) is consecutive to the third sliding support (18) and separated from the third sliding support (18) by at least a collapsible tubular element (4). In the example illustrated in FIGS. 4-6 the third sliding support (18) belongs to a repeating unit (16) while the fourth sliding support (19) belongs to an adjacent repeating unit (16); this means that each cover (17) has an extension of at least equal to the two collapsible tubular elements (4).

By again comparing the first embodiment (FIGS. 1-3) with the second embodiment (FIGS. 4-6), it is clear how in the second embodiment the covers (17) can be bigger and be in a smaller number, which advantageously simplifies the assembly operation of the roadside crash cushion (1), thus saving time.

It is clear that each repeating unit (16) can comprise a greater number of collapsible tubular elements (4).

The sliding supports (3) of the plurality of sliding supports (3) are preferably configured so that the relative fixing plates (14) are perpendicular with respect to the collapsible tubular elements (4) of the plurality of collapsible tubular elements (4).

Each end (10, 12) of each collapsible tubular element (4) can be fixed by welding to the fixing plate (14) of a sliding support (3) or to a connecting plate (20).

In FIG. 4 the covers (17) are undulated sheets, while in FIG. 5 the covers (17) are flat plates.

The above has been described by way of non-limiting example, and any constructional variants are understood to fall within the protective scope of the present technical solution, as claimed in the following.

The invention claimed is:

1. A roadside crash cushion, comprising:

a guide rail fixed to a road surface;

a plurality of sliding supports which slidably engage along the guide rail;

a plurality of collapsible tubular elements, which are made of a metal and/or a composite and/or a plastic material, which are arranged horizontally one following another, which are supported by the plurality of sliding supports and which each have a straight development and are fixed to the plurality of sliding supports;

wherein each collapsible tubular element of the plurality of collapsible tubular elements has a length and a transversal section that are in a relation to one another such as to determine an irreversible compressive deformation of the collapsible tubular element which determines the collapse thereof along a development axis thereof when the collapsible tubular element is subjected to an axial force that is at least equal to a critical force value;

wherein each sliding support of the plurality of sliding supports comprises a fixing plate and a carriage which is connected to the fixing plate and which engages with the guide rail;

the roadside crash cushion further comprising a plurality of connecting plates each disposed between, and connected to, two of the collapsible tubular elements, the connecting plates each being connected to the guide rail only via the respective two collapsible tubular elements, none of the sliding supports being disposed between the respective two collapsible tubular elements, the connecting plates serving to separate the respective two collapsible tubular elements and ensuring that the respective two collapsible tubular elements axially incur plastic compressive deformation;

wherein each collapsible tubular element of the plurality of collapsible tubular elements has (i) a first end fixed to the fixing plate of a first sliding support of the plurality of sliding supports or to a first connecting plate of the plurality of connecting plates and (ii) a second end fixed to the fixing plate of a second sliding support of the plurality of sliding supports or a second connecting plate of the plurality of connecting plates.

2. The roadside crash cushion of claim 1, wherein the collapsible tubular elements of the plurality of collapsible tubular elements are made of a sheet metal so that the irreversible deformation on compression determining the collapse of each collapsible tubular element of the plurality of collapsible tubular elements is a plastic compressive deformation.

3. The roadside crash cushion of claim 1, comprising a plurality of covers for covering the plurality of collapsible tubular elements, each cover of the plurality of covers being fixed to a third sliding support of the plurality of sliding supports and to a fourth sliding support of the plurality of sliding supports, which fourth sliding support is consecutive to the third sliding support and separated from the third sliding support by at least a collapsible tubular element.

4. The roadside crash cushion of claim 3, wherein the connecting plates of the plurality of connecting plates are arranged perpendicularly with respect to the collapsible tubular elements of the plurality of collapsible tubular elements.

5. The roadside crash cushion of claim 3, wherein the sliding supports of the plurality of sliding supports are configured in such a way that the fixing plates thereof are perpendicular with respect to the collapsible tubular elements of the plurality of collapsible tubular elements.

6. The roadside crash cushion of claim 1, wherein the connecting plates of the plurality of connecting plates are arranged perpendicularly with respect to the collapsible tubular elements of the plurality of collapsible tubular elements.

7. The roadside crash cushion of claim 6, wherein the sliding supports of the plurality of sliding supports are configured in such a way that the fixing plates thereof are perpendicular with respect to the collapsible tubular elements of the plurality of collapsible tubular elements.

8. The roadside crash cushion of claim 1, wherein the sliding supports of the plurality of sliding supports are configured in such a way that the fixing plates thereof are perpendicular with respect to the collapsible tubular elements of the plurality of collapsible tubular elements.

* * * * *